US005318292A

United States Patent [19]

De Marco

[11] Patent Number: 5,318,292

[45] Date of Patent: Jun. 7, 1994

[54] TOWEL CLAMP GOLF ACCESSORY

[76] Inventor: Nicholas A. De Marco, 18085 2nd St., Fountain Valley, Calif. 92078

[21] Appl. No.: 923,369

[22] Filed: Jul. 31, 1992

[51] Int. Cl.[5] ..... A63B 71/00

[52] U.S. Cl. ..... 273/32 B; 24/489; 24/499; 24/501; 24/511

[58] Field of Search ..... 273/32 B, 29 R; 24/530, 24/531, 532, 533, 571, 535, 536, 511, 501, 498, 499, 589, 529, 572

[56] References Cited

U.S. PATENT DOCUMENTS

| | | | |
|---|---|---|---|
| Re. 32,269 | 10/1986 | Bisk | 24/501 |
| 1,358,560 | 11/1920 | Kennison | 24/511 |
| 3,249,978 | 5/1966 | Shears | 24/532 |
| 4,701,383 | 10/1987 | Warmath | 24/530 |
| 4,878,276 | 11/1989 | Morrish | 24/511 |

FOREIGN PATENT DOCUMENTS

| | | | |
|---|---|---|---|
| 334238 | 6/1920 | Fed. Rep. of Germany | 24/529 |

*Primary Examiner*—Theatrice Brown
*Attorney, Agent, or Firm*—Hawes & Fischer

[57] ABSTRACT

A springingly urged clamp is especially useful with a small towel such as the type used in golfing service and is a palm sized clamp which is both easily manually engageable and easily manually manipulable. The clamp, and its affixed towel, can be attached to the golf bag, or any portion of the clothing to yield maximum easy utilization of the towel. In one embodiment, a golf towel's reinforcing ring is fed into a slot on one side of the clamp of the present invention and onto a post to ensure secure, but interchangeable engagement.

13 Claims, 4 Drawing Sheets

TOWEL CLAMP GOLF ACCESSORY

FIELD OF THE INVENTION

The present invention relates to the field of golfing accessories. More specifically, the present invention relates to device for facilitating the ready use of a golf towel to insure that the towel can always and easily be employed in a usable position.

BACKGROUND OF THE INVENTION

Towels and other absorbent materials are used in the game of golf for in a variety of services. Towels are used to wipe perspiration from the hands and arms, to clean soiled equipment, and dry freshly washed golf balls. Golf towels may be carried in the clothes pocket, clipped to a golf bag, or stored within a compartment on the golf bag. The method and location in which the golf towel is carried often depends upon how amenable it is to attachment. A non-attachable towel will most likely end up in the pocket of the golfer, if he has a pocket. This method of carrying can be uncomfortable especially when the towel forms a bulge in the golfers pocket. Such a bulge can be deleterious to the golfer's game the pressure of the towel is sufficient to take the golfer's concentration away from the game.

The use of a bag carried towel clip has been found handy by some golfers, but only so long as the golfer is in the vicinity of the bag to which the towel is attached. Clips are hook shaped devices with a keeper which may attach easily and detach with a good deal of effort. When the golfer is playing on the green, the golf bag is typically left at the edge of the green. This is traditional and required golf etiquette since it minimizes the damage to the green by precluding golf carts, bag carriers and bags from being carried onto the green.

In the case where the golf bag is strapped into a golf cart, the towel may be especially inaccessible. In several golf courses the movement of the golf carts onto certain areas is restricted. In either case, the golfer is then faced with the task of un-clipping the towel from the bag and then carrying it along un-clipped or re-clipped to a clothing structure such as a belt loop. The towel must be unclipped and replaced on the bag, again with the difficulty accompanying the operation of a conventional clip.

Women golfers, who may have less digital strength may have particular difficulty with the operation of a conventional clip. In addition, women golfers' clothing may lack the number and size pockets of the clothing of their male counterparts, making the carrying of a golf towel in the conventional manner more onerous.

Many golfers may wish to have a golf towel attached to the bag during fairway play and attached to the clothing during green play. What is needed is a device to facilitate the attachment of a golf towel to a wide variety of structures. The method of attachment should be quick and easy and not taxing of the strength of the hands and fingers. The device should not be subject to rust or corrosion. The device should be large enough to facilitate the easy and sure manual engagement and operation thereof.

SUMMARY OF THE INVENTION

The golf towel device, also describable as a springingly urged clamp of the present invention is a palm sized clamp which is both easily manually engageable and easily manually manipulable. The spring urged clamp of the invention can then be attached to the golf bag, or any portion of the clothing. Some of the clothing portions which are particularly susceptible to easy attachment include the belt, the top of the pants, the pants pocket, the sleeve, or the shorts leg, to name a few.

In one embodiment, a golf towel's reinforcing ring is fed into a slot on one side of the towel clamp of the present invention and onto a post to ensure secure, but interchangeable engagement. In another embodiment, a golf towel's reinforcing ring is permanently affixed onto a post by forming the end of the post extending away from the towel clamp larger than the reinforcing ring. In another embodiment, the one end of the post to ensure secure, In another embodiment, one side of the towel clamp is formed around a towel for permanent attachment, requiring no metal structures to be present. In a further embodiment, a strap sewn to a golf towel is fed through a slot on one side of the towel clamp and re-sewn onto the towel. A further embodiment involves the use of a velcro strap having a first end sewn to a golf towel and a second end having hook-like members which is fed through a slot on one side of the towel clamp and engaged with felt-like members on the same strap, but located farther from the end of the strap.

DETAILED DESCRIPTION OF THE PREFERRED EMBODIMENT

Figure 1:
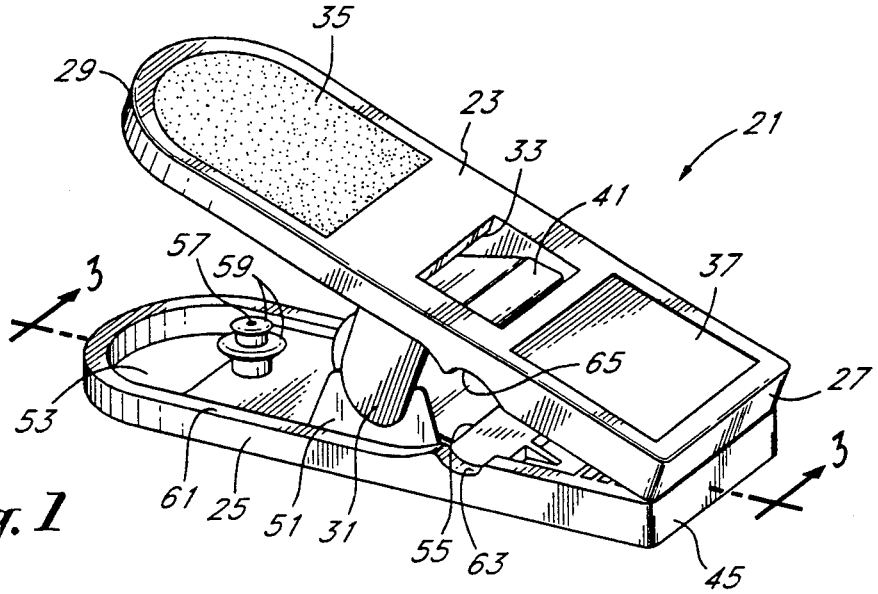
FIG. 1 is a perspective view of a first embodiment of the towel clamp of the present invention.

The description and operation of the invention will be best described with reference to FIG. 1. FIG. 1 illustrates a towel clamp 21 in perspective. Towel clamp 21 has a first pivoting member 23 and a second pivoting member 25.

First pivoting member 23 has a first end 27 which is generally flat, and a second end 29 which is generally rounded. The downwardly facing side of first pivoting member 23 has a pair of convex bearing members 31, one of which is visible in FIG. 1. First pivoting member 23 also has a rectangular shaped spring aperture 33. First pivoting member 23 also has a grip surface 35, and an indented surface 37. Grip surface 35 will ideally have a roughness equivalent to a 00 grit roughness. Indented surface 37 is ideal for attaching advertising logos where the golf clamp 21 is utilized by advertisers as gifts to promote corporate name identity. A spring 41 is shown through spring aperture 33.

Second pivoting member 25 has a first end 45 which is generally flat, and a second end 47 which is generally rounded. The first end 45 of second pivoting member 25 opposes the first end 27 of the first pivoting member 27, while the second end 47 of second pivoting member 25 opposes the second end 29 of the first pivoting member 25.

The upwardly facing side of second pivoting member 25 which faces first pivoting member 23 has a pair of concave bearing structures 51, one of which is visible in FIG. 1. Second pivoting member 23 also has an aperture 53 nearer its second, rounded end 29, and a rectangular shaped spring aperture 55 which is partially visible in FIG. 1. Second pivoting member 25 has a columnar projection 57 which extends generally perpendicularly from second pivoting member 25 and which extends upwardly from a point near aperture 53.

Columnar projection 57 may have one or more circular lands 59 along its columnar length to inhibit and hold a circular structure, particularly a circular structure having a lateral force applied to the columnar projection 57. Second pivoting member 25 has a wall 61 encompassing its perimeter for added strength and support. First pivoting member 23 also has a similar wall structure, but it is not wholly visible in FIG. 1. A notch 63 is visible in wall 61 of second pivoting member 25. An opposing notch 65 can be seen in first pivoting member 23. The Notches 63 and 65 will aid in the attachment of clamp 21 to a tubular structure.

Figure 2:
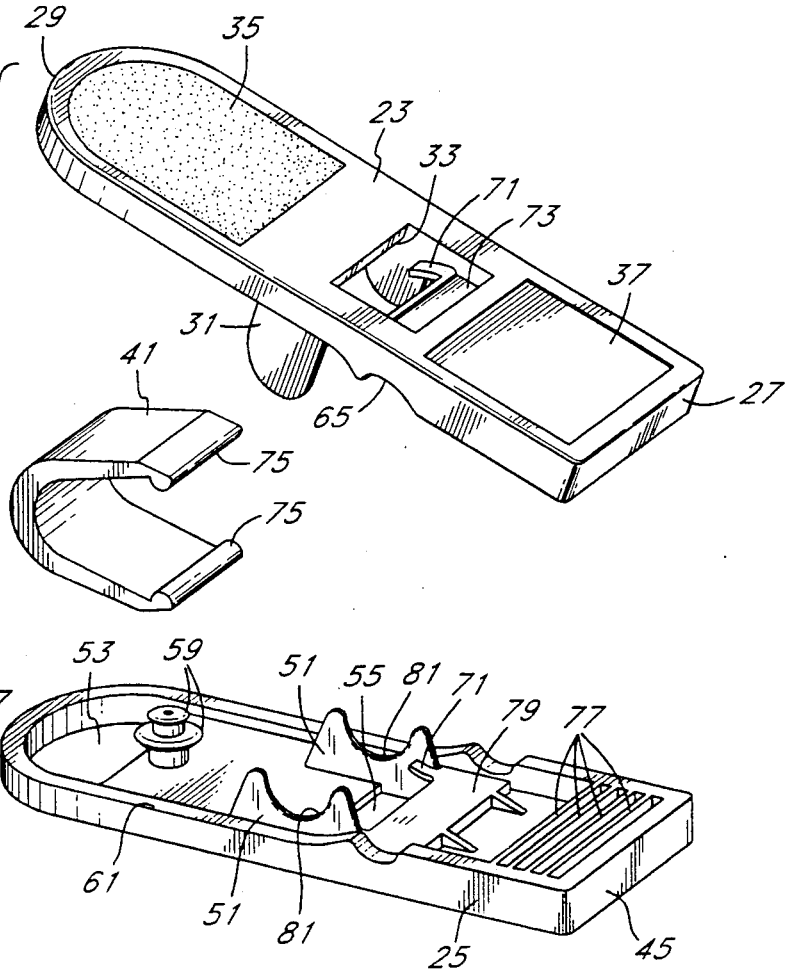
FIG. 2 is an exploded view of the first embodiment of the towel clamp of the present invention.

Referring to FIG. 2, an exploded view of the first embodiment of FIG. 1 gives a better view of first pivoting member 23, second pivoting member 25, and spring 41. The spring aperture 33 of the first pivoting member 23 can now be seen to have a ramp 71 leading to an elongate slot 73. These structures are for guiding the spring 41 into place and holding it in place, respectively.

Spring 41 can be better seen as a wide "U"-shaped piece of material. It is expected that the first and second pivoting members 23 and 25 and the spring 41 may all be made of the same material. It can also be seen that the spring 41, along its width, has a pair of raised portions 75 of a sufficient height to fit within the elongate slot 73. In assembling the golf clamp, the first and second pivoting members 23 and 25 will be brought together and the spring 41 will be urged in the direction of the first ends 27 and 45. Note that second pivoting member 25 also has a ramp 71. As the spring 41 is urged in this direction, the raised portions 75 of spring 41 engages the ramps 71. The ramps 71 act to urge the spring 41 open and guide the raised portions into the elongate slot 73. When this is done, the clamp 21 will be in the assembled state.

In FIG. 2, it can be seen that the second pivoting member 25 has a plurality of transverse ribs 77. Ribs 77 act to better secure the clamp 21 to any surface to which it is placed. Note also that a reinforcing structure 79 exists to accommodate the force on the elongate slot 73 due to the spring 41. Note also that concave bearing structure 51 has a bearing surface 81.

Figure 3:
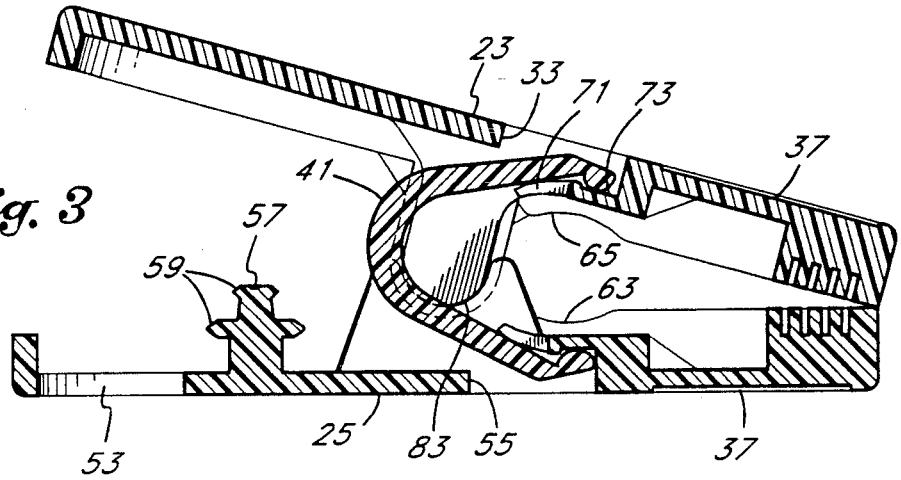
FIG. 3 is a side sectional view of the first embodiment of the towel clamp of the present invention.

Referring to FIG. 3, a side sectional view of the clamp 21 better illustrates many of the structures previously discussed. In addition, the convex bearing structure 31 can be seen to have a recessed bearing surface 83 which is engaged with the bearing surface 81 of the concave bearing structure 51. Also, a wall 85 can be seen on first pivoting member 23 corresponding to wall 61 on second pivoting member 25.

Figure 4:
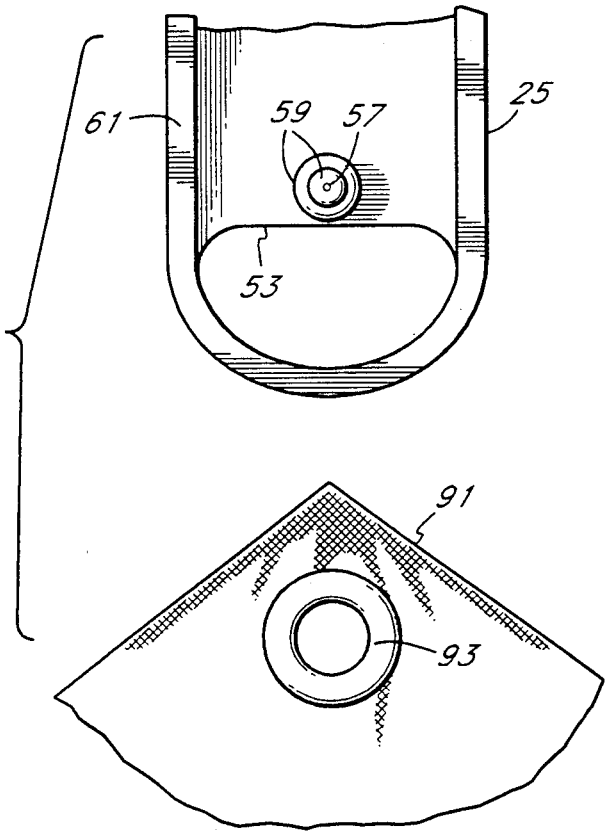
FIG. 4 is a top view of one of the pivoting members of the first embodiment of the towel clamp of the present invention.

Referring to FIG. 4, a method of attachment of a golf towel 91 having an eyelet 93 is shown. In FIG. 4, the eyelet is at the corner of towel 91, although it could be located anywhere on towel 91. Preferably the eyelet will be located at a corner or along an edge of the towel 91. In FIG. 4, only the second pivoting member 25 is shown, since the towel 91 connects only to the second pivoting member.

Figure 5:
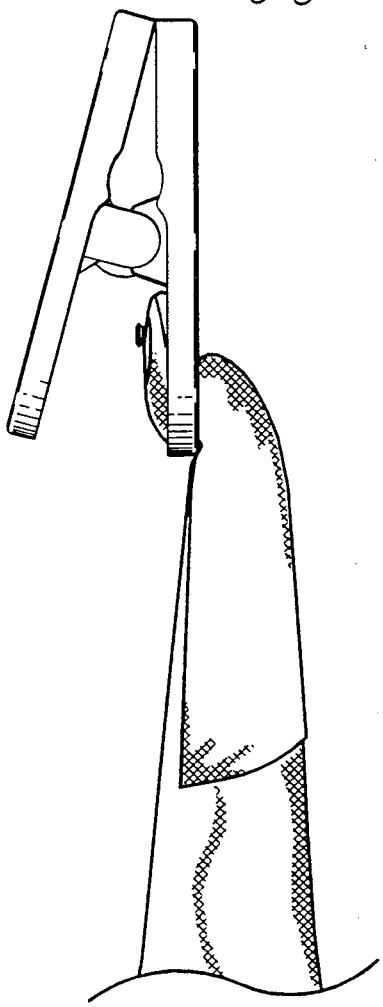
FIG. 5 is a side view of the first embodiment of the towel clamp of the present invention with a towel attached.

Referring to FIG. 5, it can be seen that the eyelet 93 is threaded through the aperture 53 of second pivoting member 25. The eyelet 93 is then passed over the columnar projection 57, including the first of the circular lands 59. In the embodiment of FIG. 5, the eyelet is of sufficiently small size to fit over the first of the circular lands 59. Tensile pressure on the towel 91 to now pull it from the aperture 53 will cause the eyelet to engage the columnar projection 57 between the two circular lands 59, causing it to be temporarily locked into place.

In the case where the eyelet 93 is sufficiently large, it will fit over the second of the circular lands 59, and be locked into place below the second of the circular lands 59. In the configuration of FIG. 5, the clamp 21—towel 91 combination is now suited to be clamped to an individual's waistband, pocket, pants or shirt material, golf bag, golf cart, golf club, or other structure.

There are several alternative embodiments each employing a different method for attachment of towel 91 to second pivoting member 25. Since the clamp 21 may be made completely of plastic material, the clamp 21 may be washed along with the towel 91 without detrimental effect.

Figure 6:
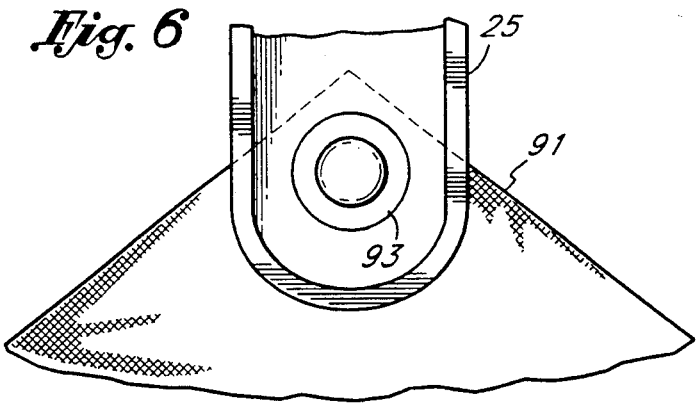
FIG. 6 is a top view of one of the pivoting members of a second embodiment of the towel clamp of the present invention.
Figure 7:
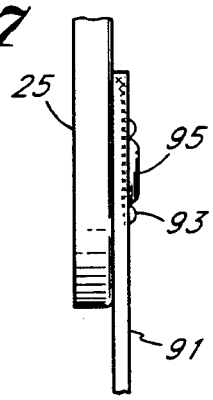
FIG. 7 is a side view of one of the pivoting members of the second embodiment of the towel clamp of the present invention.

Referring to FIG. 6, a modified form of the columnar projection 57 is shown. Here, the eyelet 93 is riveted to the second pivoting member 25 using an integrally formed rivet 95. This is typically performed in manufacturing by forming a straight projection, placing the eyelet 93 over the projection, and melting the end of the projection into a mushroom structure bigger than the eyelet 93 to form the rivet 95. Rivet 95 may also be a two headed rivet. FIG. 7 illustrates a side view of the assembly shown in FIG. 6. Note that the aperture 53 does not need to be present in this embodiment.

Figure 8:
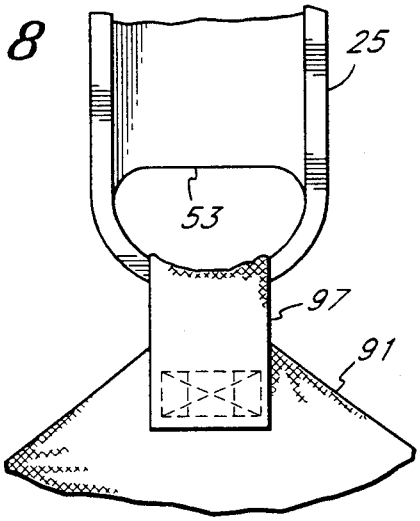
FIG. 8 is a top view of one of the pivoting members of a third embodiment of the towel clamp of the present invention.
Figure 9:
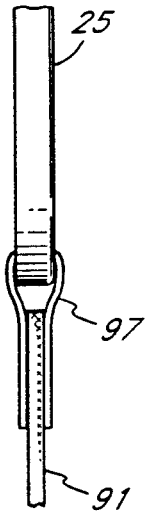
FIG. 9 is a side view of one of the pivoting members of the third embodiment of the towel clamp of the present invention.

Referring to FIG. 8, a modified form of attachment is shown which does not utilize nor contain the columnar projection 57. Here, a loop of cloth type material 97 is made to pass through aperture 53. Both ends of the cloth material 97 are sewn to the towel 91. In this embodiment, the clamp 21 is permanently affixed to the towel 91, and involves the use of no metal parts. FIG. 9 illustrates a side view of the assembly shown in FIG. 8.

Figure 10:
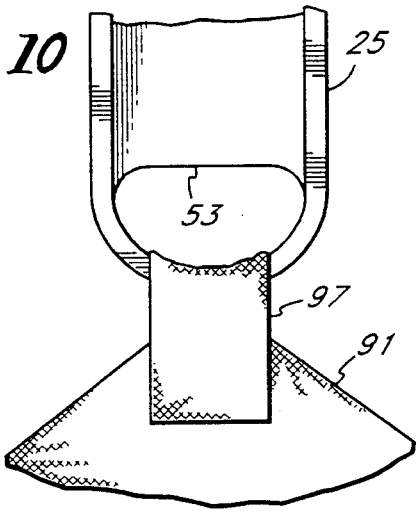
FIG. 10 is a top view of one of the pivoting members of a fourth embodiment of the towel clamp of the present invention.
Figure 11:
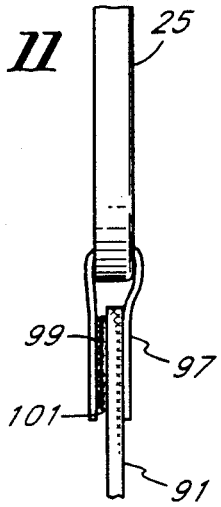
FIG. 11 is a side view of one of the pivoting members of the fourth embodiment of the towel clamp of the present invention.

Referring to FIG. 10, a modified forth of attachment is shown, similar to that shown in FIG. 8, in which the towel 91 is detachable from the clamp 21. Here, only one end of a loop of cloth material 97 is sewn to the towel 91. Referring to FIG. 11, the other end of the loop of cloth material 97 is made to attach either to itself or to the towel 91 through the use of hook-like members 99 engaged with felt-like members 101, commonly known as velcro. As shown in FIG. 11, the hook-like members are attached to the felt-like members 101 located on the cloth material 97. The felt-like members 101 may also be located on the cloth material 97. In this embodiment, the clamp 21 may be removed from the towel 91, as was the case for the first embodiment.

Figure 12:
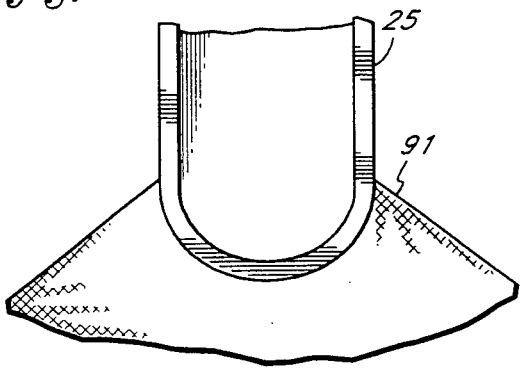
FIG. 12 is a top view of one of the pivoting members of a fifth embodiment of the towel clamp of the present invention.
Figure 13:
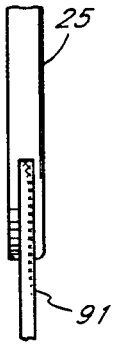
FIG. 13 is a side view of one of the pivoting members of the fifth embodiment of the towel clamp of the present invention.

Referring to FIG. 12, a modified permanent form of attachment is shown. Here, the material forming the second pivoting member 25 encases a portion of the towel 91. Where the second pivoting member 25 is injection molded, it may be so molded with the corner or portion of the towel 91 in the mold. Similarly, the second pivoting member 25 may be formed in two pieces which are heated to the point that a portion of the material is absorbed into the structure of the second pivoting member 25, to cause it to be structurally intermingled with a portion of the towel 91. FIG. 13 illustrates a side view of the assembly shown in FIG. 12.

Figure 14:
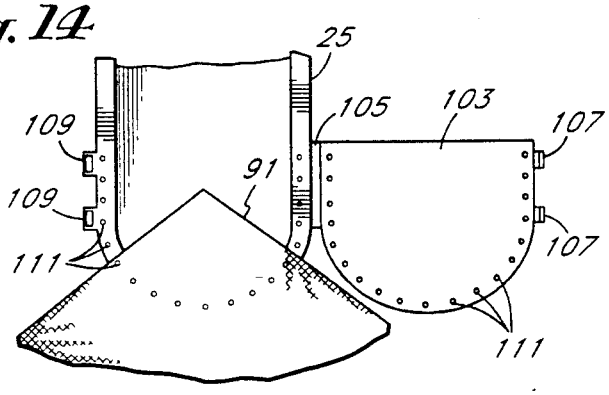
FIG. 14 is a top view of one of the pivoting members of a sixth embodiment of the towel clamp of the present invention.

Referring to FIG. 14, a detachable form of attachment is shown. Here, the second pivoting member 25 includes a snap fit door formed integrally with the second pivoting member 25. The retaining member 103 is connected to the second pivoting member 25 through an elongate hinge 105, which is sufficiently formed to enable door 105 to bend fully onto second pivoting member 25.

At the side of door 105 opposite the elongate hinge 105 is a pair of engagement members 107. At the side of the second pivoting member 25 is a pair of engagement members 109 which are engageable with engagement members 107. Adjacent the periphery of both retaining member 103 and second pivoting member 25 is a series of evenly spaced small post-like projections 111. These projections 111 are designed to engage the fibers of the towel 91 and prevent lateral movement of the towel 91 with respect to both retaining member 103 and second pivoting member 25 when retaining member 103 is closed onto second pivoting member 25. Projections 111 may be cone shaped, cylindrically shaped, or have any other configuration readily engageable with the material of towel 91.

Figure 15:
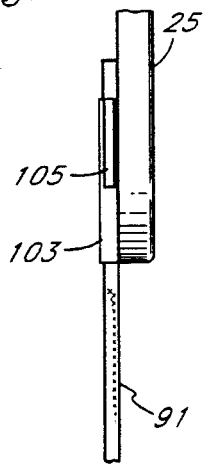
FIG. 15 is a side view of one of the pivoting members of the sixth embodiment of the towel clamp of the present invention.

When retaining member 103 is closed onto second pivoting member 25 and when the engagement members 107 are engaged with the engagement members 109, the towel 91 will be locked in place with respect to the second pivoting member 25 and therefore with respect to the clamp 21. FIG. 15 illustrates a side view of the assembly shown in FIG. 14.

Figure 16:
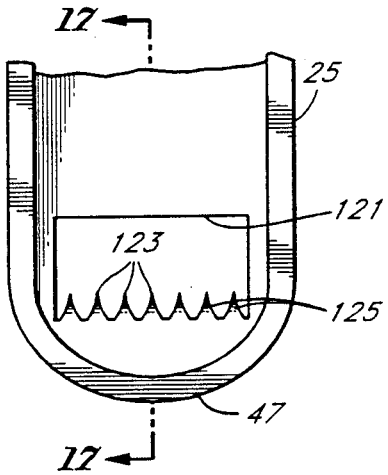
FIG. 16 is a top view of one of the pivoting members of a seventh embodiment of the towel clamp of the present invention.
Figure 17:
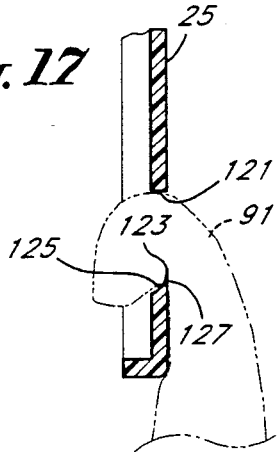
FIG. 17 is a side sectional view of one of the pivoting members of the seventh embodiment of the towel clamp of the present invention.

Referring to FIG. 16, another detachable form of attachment is shown. Here, the second pivoting member 25 includes a rectangular opening 121 having a series of teeth 123 extending in a direction generally parallel to the second pivoting member 25 and in a direction away from second end 47. Referring to FIG. 17, a side sectional view taken along line 17—17 of FIG. 16 bisects one of the teeth 123. The teeth 123 can be seen to have a sloping edge 125 facing inwardly, and a flat edge 127 facing outwardly.

Teeth 123 and opening 121 are configured to enable a towel 91 to be threadably inserted therethrough and engaged with the teeth 123 to hold the towel 91 in place. To remove the towel 91, it can be pushed out of the opening 91 with the small end, in small steps. In this configuration, any type towel can be used, and only a small portion of the towel required to hold it to second pivoting member 25.

The rigidity, strength, and resistance to degradation of the towel clamp 21 will be based upon its materials of construction. Ideally, towel clamp 21, including the spring 41, first pivoting member 23 and second pivoting member 25 will be made of the same material. Also, its ideal dimensions for use as a golf towel are about 3 and $\frac{3}{8}$ inches long and about 1 and $\frac{3}{8}$ inches wide and about $\frac{1}{8}$ of an inch thick.

The preferable material of construction is a glass reinforced polycarbonate resin, such as the commercially available LEXAN ®made by General Electric Plastics. A resin grade 3412 in black (739), as described in the *GE Plastics U.S.A. Price Schedule,* is "20% glass reinforced for improved rigidity, dimensional stability, creep and heat resistance." With this material, the towel clamp 21 should produce its ideal holding pressure of about 30 pounds force.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed is:

1. A towel clamp comprising:

a first pivoting member having a first end and a second end, a first and a second side, and a spring aperture and a pair of convex bearing surfaces extending generally perpendicular from the first side of its surface;

a second pivoting member having a first end and a second end, a first and a second side, and a spring aperture and a pair of concave bearing surfaces extending generally perpendicular from the first side of its surface, the concave bearing surfaces of said second pivoting member matable with said convex bearing surfaces of said first pivoting member when said first pivoting member is brought into opposing position with respect to said second pivoting member;

means for attaching a towel to said second pivoting member further comprising a columnar projection extending from said first side of said second pivoting member, and wherein said second pivoting member has an aperture nearer its second end; and spring means engaging said first and second pivoting members at their spring apertures for urging the first ends of said first and second pivoting members towards each other.

2. The towel clamp recited in claim 1 wherein said columnar projection lies between said aperture and said convex bearing surfaces.

3. The towel clamp recited in claim 1 wherein said spring means further comprises a spring having a first edge, a length of material extending away from the first edge to a U-shaped fold, extending away from the U-shaped fold in a direction parallel to said length of material and terminating in a second edge opposing said first edge.

4. The towel clamp recited in claim 1 further comprising a golf towel having a reinforcement ring threaded through said aperture and engaging said columnar projection.

5. The towel clamp system of claim 4 wherein said end of said columnar projection is expanded to lock said reinforcement ring of said towel.

6. The towel clamp system of claim 1 wherein said first and said second pivoting members define a slot along one edge of said spring apertures for receiving said spring means.

7. The towel clamp system of claim 1 further comprising a pair of ramps extending from one side of said spring aperture and said slot and away from said first surface of at least one of said first and second pivoting members.

8. The towel clamp system of claim 1 further comprising a rectangular depression on said second side of at least one of said first and said second pivoting members.

9. The towel clamp recited in claim 1 wherein the first sides of said first and second pivoting members have a set of transverse ribs near the first ends of said first and second pivoting members.

10. A towel clamp comprising:

a first pivoting member having a first end and a second end, a first and a second side, and a spring aperture and a pair of convex bearing surfaces extending generally perpendicular from the first side of its surface;

a second pivoting member having a first end and a second end, a first and a second side, and a spring aperture and a pair of concave bearing surfaces extending generally perpendicular from the first side of its surface, the concave bearing surfaces of said second pivoting member mateable with said convex bearing surfaces of said first pivoting member when said first pivoting member is brought into opposing position with respect to said second pivoting member;

an aperture in said second pivoting member nearer its second end, for attaching a towel to said second pivoting member;

spring means engaging said first and second pivoting members at their spring apertures for urging the first ends of said first and second pivoting members towards each other;

a towel; and a loop of material having a first end attached to said towel and extending through said aperture of said second pivoting member and terminating in a second end attached to said towel.

11. The towel clamp recited in claim 10 wherein said second end of said loop of material has at least one of a set of hook-like members and a set of felt-like members, and where the other of a set of hook-like members and a set of felt-like members is attached to said towel.

12. A towel clamp comprising:

a first pivoting member having a first end and a second end, a first and a second side, and a spring aperture and a pair of convex bearing surfaces extending generally perpendicular from the first side of its surface;

a second pivoting member having a first end and a second end, a first and a second side, and a spring aperture and a pair of concave bearing surfaces extending generally perpendicular from the first side of its surface, the concave bearing surfaces of said second pivoting member mateable with said convex bearing surfaces of said first pivoting member when said first pivoting member is brought into opposing position with respect to said second pivoting member, said second end of said second pivoting member having a series of spaced post-like projections, said second pivoting member also having a first engagement member; and a retaining member, hingeably attached to said second pivoting member, said retaining member also having a series of spaced post-like projections, said retaining member also having a second engagement member engageable with said first engagement member of said second pivoting member;

spring means engaging said first and second pivoting members at their spring apertures for urging the first ends of said first and second pivoting members towards each other;

a golf towel having a portion of its surface enclosed by said retaining member and said second pivoting member, said first and second engagement members for lockably closing said retaining member onto said second pivoting member to cause the post-like projections to opposingly engage said golf towel.

13. The towel clamp recited in claim 12 wherein the second pivoting member and the retaining member are integrally formed.

* * * * *